United States Patent [19]

Berta et al.

[11] Patent Number: 4,596,910

[45] Date of Patent: Jun. 24, 1986

[54] HIGH-VOLTAGE CIRCUIT BREAKER

[75] Inventors: Riccardo Berta, Neuenhof; Blaise Perrenoud, La Neuveville, both of Switzerland

[73] Assignee: BBC Brown, Boveri & Company, Limited, Baden, Switzerland

[21] Appl. No.: 657,258

[22] Filed: Oct. 3, 1984

[30] Foreign Application Priority Data

Oct. 28, 1983 [CH] Switzerland ..... 5836/83

[51] Int. Cl.[4] ..... H01H 33/12

[52] U.S. Cl. ..... 200/146 R; 200/147 R; 200/144 R

[58] Field of Search ..... 200/146 R, 144 R, 144 AP, 200/147 R

[56] References Cited

U.S. PATENT DOCUMENTS

| | | | |
|---|---|---|---|
| 3,553,532 | 1/1971 | Cheshire | 317/100 |
| 4,028,794 | 6/1977 | Ritchie et al. | 29/629 |
| 4,086,461 | 4/1978 | Gonek | 200/146 R |
| 4,109,299 | 8/1978 | Coesentino | 361/412 |
| 4,245,876 | 1/1981 | Ritchie et al. | 339/59 |
| 4,338,500 | 7/1982 | Pham Van et al. | 200/146 R |
| 4,463,230 | 7/1984 | Perrenoud | 200/146 R |

*Primary Examiner*—Robert S. Macon

*Attorney, Agent, or Firm*—Burns, Doane, Swecker & Mathis

[57] ABSTRACT

An electric high-voltage circuit breaker is provided with two coaxially arranged contact members, which are movable relative to each other, with one rated-current contact (5, 7) and one burning contact (5, 7) each. The rated-current contact (7) and burning contact (7) of one movable one of the two contact members are frictionally joined to each other via a support part. The end, turned away from a stationary one of the two contact members, of the rated-current contact of the movable contact member is in contact, in a sliding manner, with a current supply of this contact member. This breaker is to be further developed in such a manner that the use of an additional sliding contact between the burning contact and the current supply can be omitted even when switching extremely large currents. This is achieved by the fact that the rated-current contact of the movable contact member is formed by contact fingers which are elastically supported on the support part (18) and that the support part is constructed to be electrically conductive and has a contact surface which acts in conjunction with the contact surfaces of the contact fingers after separation of the rated-current contacts. Such a breaker is preferably used as a generator switch.

7 Claims, 1 Drawing Figure

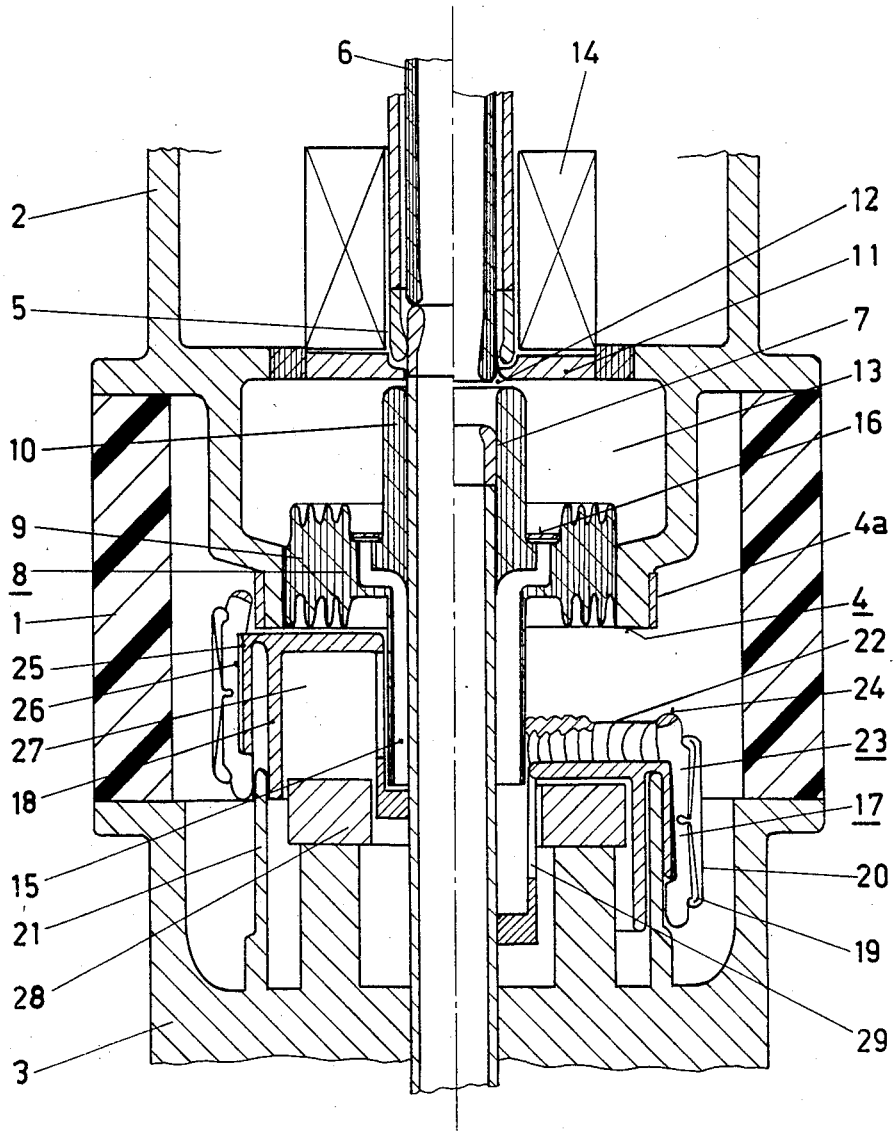
6
14
2
12
11
5
7
13
10
16
9
4a
8
4
1
22
25
24
26
27
23
18
17
15
20
21
19
28
29
3

HIGH-VOLTAGE CIRCUIT BREAKER

BACKGROUND OF THE INVENTION

The invention relates to a high-voltage circuit breakers and more particularly to contact arrangements for such breakers. A known prior breaker has two coaxial contact members which are movable with respect to each other and which are provided with burning and rated-current contacts. In a movable one of the two contact members, the rated-current contact is frictionally joined to the burning contact via a support part. The end turned away from a stationary one of the two contact members of the rated-current contact is, in a sliding manner, in continuous contact with a current supply of the movable contact member. This makes it possible to transfer and switch currents in a reliable and constructionally simple manner. However, for this purpose a sliding contact arranged between the current conducting arrangement and the burning contact of the movable contact member is also needed. Such sliding contacts are relatively expensive and susceptible to wear.

OBJECTS AND BRIEF SUMMARY OF THE INVENTION

The present invention has the object of providing a breaker of the type described above which enables extremely large and extremely small current to be transferred and switched in a reliable manner by simple means even after numerous switching processes.

This object is accomplished in accordance with this invention by a high-voltage circuit breaker of the type having a burning contact and a rated current contact wherein the initial current contact is formed by contact fingers which, in the switched off position, are arranged in an elastic manner between a support and a cage. The support is electrically conductive and acts in conjunction with the contact surface of the contact fingers after separation of the rated-current contacts.

By virtue of a suitable arrangement and construction of the rated-current contacts of the breaker according to the invention, a sliding contact which is susceptible to wear can be omitted between the current supply and the burning contact. Simultaneously, the elements determining the breaking capacity and the constant current transmission, such as the movable current-conducting parts, the contact pressure transmitters and a blasting mechanism, possibly provided can be matched to one another in such a manner that extremely large and small currents can be reliably controlled even after numerous switching actions.

BRIEF DESCRIPTION OF THE DRAWING

A preferred embodiment of the invention is illustrated in the accompanying drawing in which the single FIGURE is a longitudinal cross-sectional view of a high-voltage circuit breaker constructed in accordance with the invention, in which the breaker is shown in the switched-on position in the left half of the FIGURE and in the switched-off position in the right half of the FIGURE.

As shown in the FIGURE, a hollow, cylindrical insulating body 1 is secured between two hollow current conductors 2 and 3 in a gastight manner.

The current conductors 2 carries a stationary contact member with an annular rated-current contact 4 provided with contact portions 4*a* of arc-resistant material which are uniformly distributed along its periphery, and a burning contact 5 of hollow construction in the interior of which a nozzle-shaped insulating-material part 6 is arranged which, in the switched-on position (left half of the FIGURE) is pushed by a movable, nozzle-shaped burning contact 7 against the force of a spring (not shown) into the interior of the burning contact 5. In the interior of the current conductor 2, an insulating-material body 8 is mounted. This insulating-material body 8 is provided with an insulator 9, provided with annular ribs, and an adjoining tubular insulating-material part 10. In the switched-off condition, the insulator 9 produces a leakage-current proof insulating space between the rated-current contact 4 and the burning contact 7. The insulating-material part 10 is penetrated by the burning contact 7 and, at its end facing the stationary contact member, delimits, together with an arcing ring 11 mounted in an insulating manner at the current conductor 2, an annular gap 12. The annular gap 12 joins a heating volume 13 enclosed by the current conductor 2, the insulating-material body 8 and the arcing ring 11 to the arc-quenching zone located between the open burning contacts 5 and 7 during a switching operation. The arcing ring 11 consists of an arc-resistant material and, like the burning contact 5, is connected to the one connection of a coil 14, the other connection of which is electrically conductively connected to the current conductor 2. An annular duct 15 extending along the burning contact 7 and against which the heating volume 13 can be blocked off via a back-pressure valve 16 opens into the heating volume 13.

The current conductor 3 carries a movable contact member which is attached coaxially to the stationary contact member and which has a movable rated-current contact 17 and the movable burning contact 7. The movable rated-current contact 17 contains contact fingers which are supported parallel to one another on the outer surface of a support part 18 of electrically conductive material which is rigidly joined to the movable burning contact 7. The contact fingers are supported in an elastic manner in a hollow-cylindrical cage 20 by means of leaf springs 19, each of which has a contact surface at each end. The one contact surface is supported, both in the switched-on and in the switched-off condition, on the outer surface of an annular extension 21 of the current conductor 3 whereas the other contact surface bears against the stationary rated-current contact 4 only in the switched-on condition.

A first part of contact fingers 22 is chamfered, (not apparent from the FIGURE) at the ends turned away from the stationary contact member, whereas a second part of contact fingers 23 projects past the contact fingers 22 at the ends facing the stationary contact member and is constructed to be arc resistant at the projecting ends. The contact fingers 23 can be produced in a simple manner by applying contact parts 24 of arc-resistant material to the chamfered ends of contact fingers 22 and inserting these contact fingers, turned 180° relative to the contact fingers 22, between the support part 18 and the cage 20 during assembly.

The outside of the support part 18 is provided with a cylindrical jacket shaped contact surface 25 which, in a switched-off condition, contacts the contact surfaces 26 which are mounted in recesses of the contact fingers 22 and 23.

In the support part 18, an annular compression space 27 is recessed which is closed by an annular piston 28 which is rigidly attached to the current conductor 3. On the inner surface of the support part 18, slots 29 are provided which join the compression space 27 to the heating volume 13 via the annular duct 15.

The interior of the housing delimited by the insulating-material body 1 and the current conductors 2 and 3 is filled with an insulating gas such as, for example, sulphur hexafluoride, at a pressure of some bars.

The high-voltage circuit breaker according to the invention operates as follows:

In the switched-on position (left half of the FIGURE), the movable burning contact 7 passes through the arcing ring 11 and is introduced into the stationary burning contact 5. The face of the movable burning contact 7 bears against the face of the insulating-material part 6 which closes the interior of the burning contacts 5 and 7 off with respect to the heating volume 13. The contact surfaces, facing the stationary contact member, of all contact fingers 22 and 23 of the movable rated-current contact 17 bear against the stationary rated-current contact 4. The predominant part of the current now flows from current connector 2 via the rated-current contact 4, the rated-current contact 17 and the extension 21 to the current connector 3.

During breaking, the burning contact 7, provided with a drive, not shown, and thus also the rated-current contact 17, which is frictionally connected to the burning contact 7 via the support part 18, is moved downwards. During this movement, initially the contact fingers 22 are disengaged from the rated-current contact 4 and simultaneously the contact surfaces 26 of the contact fingers 22 and the contact surface 25 of the support part 18 come into contact. Since the contact parts **4*a* are attached in such a manner that they act in conjunction with the contact parts 24 in the switched-on position, the current now flows via the current conductor 2, the arc-resistant contact parts 4*a*, the arc-resistant contact parts 24, the contact fingers 23 and the extension 21 to the current conductor 3**.

As soon as contact parts **4*a* and 24 separate, the contact surfaces 26 of the contact fingers 23 are brought into contact with the contact surface 25 of the support part 18 and the current is commutated into a parallel current path which flows from current conductor 2 via the coil 14, the burning contact 5, the burning contact 7, the support part 18, the contact fingers 22 and 23 and the extension 21 to the current conductor 3. An arc which may occur during the commutating process when switching large currents is drawn between the arc-resistant contact parts 4*a* and 24. Since these parts are constructed to be arc resistant, damage to the rated-current contacts 4 and 17** is prevented while simultaneously retaining good current carrying capacity in the switched-on position.

After commutation of the current, the burning contacts 5 and 7 separate and an arc, not shown, is drawn between these two contacts, the root of which arc, located at the burning contact 5, commutates in the course of the further breaking process to the arcing ring 11, under the action of the insulating-material part 6 which is moving downwards. The current now flows through the current conductor 2, the coil 14, the arcing ring 11, the arc (not shown), the burning contact 7, the support part 18, the contact fingers 22 and 23 and the extension 21 to the current conductor 3. Under the action of the magnetic field of the coil 14, through which current now flows, the arc begins to rotate around the contact member axis and to heat up the insulating gas located in the quenching zone. Under the action of centrifugal forces, the heated quenching gas is transported outwards and a pressure reduction is caused at the nozzle openings of the insulating-material part 6 and of the burning contact 7 and, in contrast, a pressure increase is caused at the periphery of the mass of gas rotating in the arc quenching zone. The heated quenching gas flows through the annular gap 12 into the heating volume 13 where it is stored, depending on the intensity of the current to be switched off, at pressure values which are several bars above the pressure value of the unheated insulating gas, and is simultaneously calmed and cooled. Shortly before the zero transition of the current, when the heating effect of the switching arc has abated and the pressure of the quenching gas in the heating volume 13 exceeds the pressure of the quenching gas in the arc quenching zone, the compressed quenching gas emerges from the heating volume 13 via the annular gap 12 and blasts the weakening arc to an increased extent which prevents re-ignition of the arc with sufficient contact spacing.

When small currents are switched, the power of the arc is inadequate for generating a quenching-gas pressure in the heating volume which is adequate for quenching the switching arc. However, adequate blasting of the switching arc drawn with small currents is made possible via insulating gas which is condensed in the compression space 27 during a switching process and is blown into the quenching zone via the slots 29, the annular duct 15, the back-pressure valve 16, the heating volume 13 and the annular gap 12. The advantageous effect of such additional blasting is available in accordance with the arrangement of the heating volume 13 without the disadvantage of an additional space requirement for the heating volume 13 arranged in the current conductor 2. Neither is any additional space required for the compression space 27 of the additional blasting since this compression space 27 can be comfortably accommodated in the already existing support part 18.

We claim:

1. A high-voltage circuit breaker of the type having two coaxial contact members which are movable with respect to each other and each of said members having a rated-current contact and a burning contact in which the rated-current contact and the burning contact of a first one of the two contact members are frictionally joined to each other through a support part and the end, turned away from the second one of the two contact members, of the rated-current contact of the first contact member is in contact, in a sliding manner, with a current supply of this contact member, the improvement comprising: contact fingers forming said rated-current contact of the first contact member, said fingers when in the switched off position, are arranged in an elastic manner between the support part and a cage which annularly surrounds the support part and said support part being constructed to be electrically conductive and has a contact surface which acts in conjunction with a contact surface of the contact fingers after separation of the rated-current contacts.

2. A breaker according to claim 1, wherein a first part of the contact fingers is chamfered at the ends turned away from the second contact member and a second part of the contact fingers is constructed to be arc resistant at the ends facing the second member, the rated-current contact of the second contact member is provided with arc-resistant contact parts, which are distributed along its periphery and which work in conjunction with the arc-resistant ends of the contact fingers of the second part of the contact fingers.

3. A breaker according to claim 1, wherein the rated-current contact of the second contact member is attached to a current supply, which at least partially reaches below the burning contact of the first contact member and forms the outer wall of a heating volume and that the heating volume is joined by an annular gap to the arc quenching zone located during a switching process between the two burning contacts.

4. A breaker according to claim 1, wherein a heating volume can be joined to a compression space which is recessed into the support part.

5. A breaker according to claim 2, wherein the rated-current contact of the second contact member is attached to a current supply, which at least partially reaches below the burning contact of the first contact member and forms the outer wall of a heating volume and that the heating volume is joined by an annular gap to the arc quenching zone located during a switching process between the two burning contacts.

6. A breaker according to claim 2, wherein a heating volume can be joined to a compression space which is recessed into the support part.

7. A breaker according to claim 3, wherein the heating volume can be joined to a compression space which is recessed into the support part.

* * * * *